US005636897A

United States Patent [19]

Zapf

[11] Patent Number: 5,636,897

[45] Date of Patent: Jun. 10, 1997

[54] SEATING FURNITURE COVER

[76] Inventor: Otto W. Zapf, Theresenstrasse 28, 61462, Konigstein, Germany

[21] Appl. No.: 518,151

[22] Filed: Aug. 23, 1995

[51] Int. Cl.[6] ..... A47C 31/11

[52] U.S. Cl. ..... 297/228.1; 297/224; 297/229

[58] Field of Search ..... 297/228.1, 229, 297/224; 5/907, 482, 485

[56] References Cited

U.S. PATENT DOCUMENTS

| | | | |
|---|---|---|---|
| 1,619,556 | 3/1927 | Aaron | 297/228.1 |
| 1,748,743 | 2/1930 | Wedler | 297/224 |
| 1,820,104 | 8/1931 | Whaley | 297/224 |
| 1,889,662 | 11/1932 | Hyman | 297/229 X |
| 2,191,963 | 2/1940 | London | 297/228.1 X |
| 3,298,047 | 1/1967 | Feinerman | 297/228.1 X |
| 3,586,370 | 6/1971 | Barecki et al. | 297/229 X |
| 4,232,898 | 11/1980 | Bodrero | 297/224 X |
| 4,400,030 | 8/1983 | Maruzzo et al. | 297/228.1 |
| 4,693,511 | 9/1987 | Seltzer et al. | 297/228.1 |
| 4,759,090 | 7/1988 | Sachetti | 5/482 |
| 4,934,939 | 6/1990 | Bonneville | 5/485 X |
| 5,028,472 | 7/1991 | Gray | 297/228.1 X |
| 5,127,115 | 7/1992 | Williams et al. | 5/482 X |
| 5,208,926 | 5/1993 | Stackhouse | 5/482 |
| 5,506,019 | 4/1996 | Abeyta et al. | 297/229 X |

FOREIGN PATENT DOCUMENTS

| | | | |
|---|---|---|---|
| 268070 | 1/1969 | Austria | 297/228.1 |
| 1920529 | 10/1970 | Germany | 297/229 |
| 1075296 | 1/1967 | United Kingdom | 297/228.1 |

*Primary Examiner*—Peter M. Cuomo
*Assistant Examiner*—Rodney B. White
*Attorney, Agent, or Firm*—Kirschstein, et al.

[57] ABSTRACT

An article of seating furniture includes a support structure that has oppositely facing major surfaces and a circumferential edge portion extending between the major surfaces. A cover is provided for the support structure, such cover including two major portions each juxtaposed with one of the major surfaces of the support structure and a continuous band juxtaposed with the edge portion of the support structure mid connected along respective seams with each of the two major portions of the cover. The band is visually distinguishable from the remainder of the covers, such as by being provided with visually distinguishable symbols distributed along its length.

9 Claims, 2 Drawing Sheets

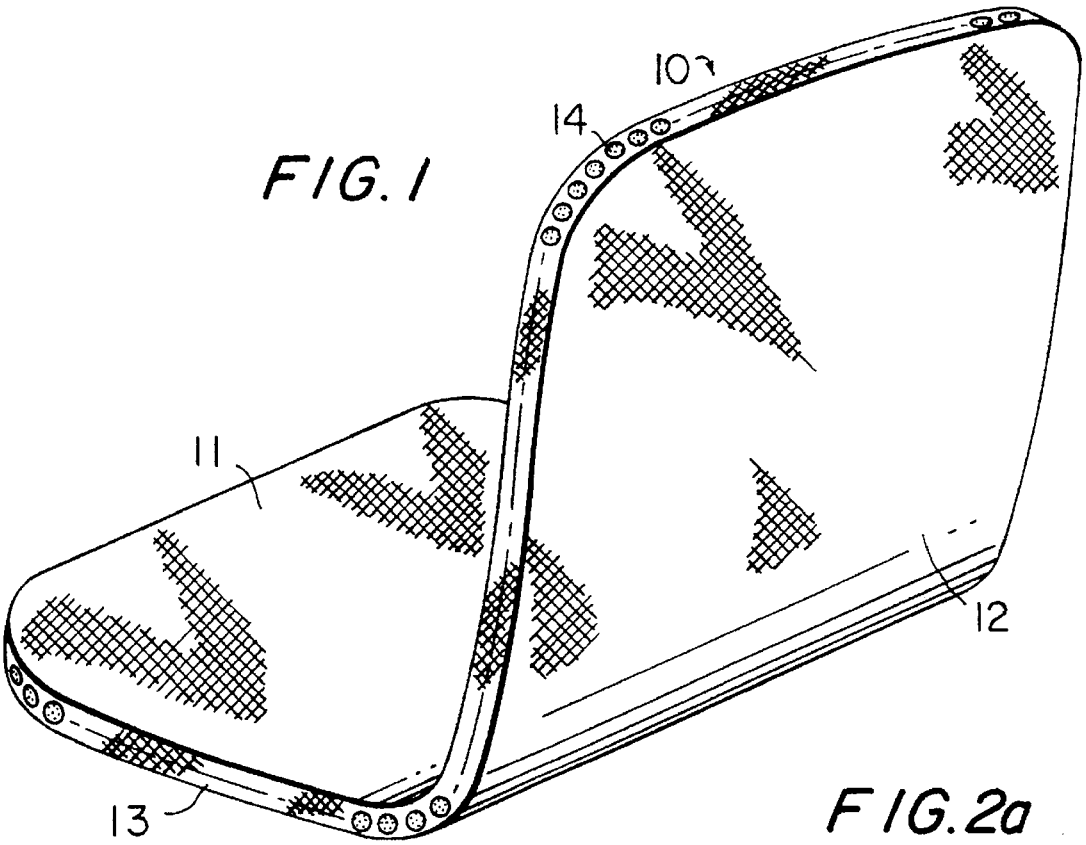
FIG. 1
FIG. 2a
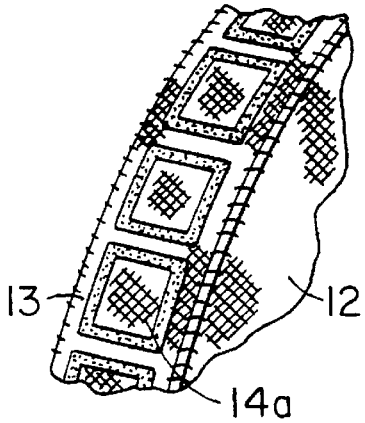
FIG. 2b
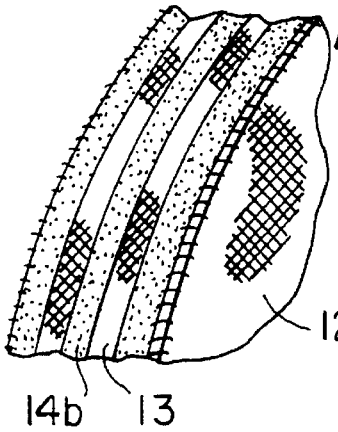
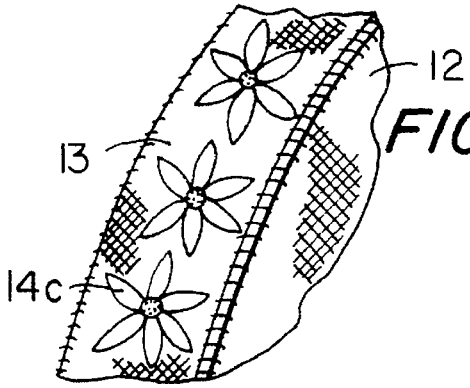
FIG. 2c

SEATING FURNITURE COVER

BACKGROUND OF THE INVENTION

1. Field of the Invention

The present invention relates to furniture in general, and more particularly to an article of seating furniture that includes at least a covered seat portion but possibly also a covered backrest portion.

2. Description of the Related Art

There are already known various constructions of articles of seating furniture of the type here under consideration, among them such that are provided with permanent covers. In the latter context, it is the usual practice to make the cover of the same fabric or similar textile material all over. This, of course, reduces the aesthetic and other appeal of such furniture articles to an absolute minimum.

3. Objects of the Invention

Accordingly, it is a general object of the present invention to avoid the disadvantages of the prior art.

More particularly, it is an object of the present invention to provide a seating furniture that does not possess the drawbacks of the known furniture of this type.

Still another object of the present invention is to devise a seating furniture office type here under consideration that includes a cover for its support structure and has a heightened aesthetic appeal or information content than previously known covers of this kind.

It is yet another object of the present invention to design the above seating furniture cover in such a manner as to convey a visual signal.

A concomitant object of the present invention is so to construct the seating furniture cover of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an article of seating furniture that comprises a support structure including at least a seating portion and has oppositely facing major surfaces mid a circumferential edge portion extending between the major surfaces; and a cover for the support structure that includes two major portions each juxtaposed with one of the major surfaces of the support structure and a continuous band juxtaposed with the edge portion of the support structure and connected along respective seams with each of the two major portions of the cover.

The support structure may further include a backrest portion connected with the seating portion, in which case the cover covers at least one of the seating and backrest portions. Advantageously, the seating and backrest portions of the support structure are integral with and merge into one another; trader these circumstances, the cover continuously covers both the seating portion and the backrest portion of the support structure.

In accordance with an advantageous aspect of the present invention, the presence of the band itself conveys an optical or visual signal so long as the band is visually distinguishable from the aforementioned two major portions of the cover. The conveyance of an optical signal is to be understood in this context in the general sense. Thus, generally speaking, a region of the cover that is suited for this purpose is to be optically distinguishable from the remainder of the cover, be it because company emblems are provided thereon or because it optically stands out from the adjacent regions in some other way. The two major portions of the cover have the customary appearance, while the aforementioned band extends along the edge portion of the respective support structure and, in accordance with the present invention, is optically different from the remainder of the cover.

Thus, for example, in accordance with another facet of the present invention, the band is provided with visually distinguishable symbols distributed along its length. Such symbols may be constituted by company logos, emblems of various kinds, lettering, possibly in the form of continuous text, numbers, various symbols in general, ornamental features such as meandering ornaments, stripes, flowers or blooms, markings or the like. What is important in this context is that the continuous band is optically differentiated frown the remainder of the cover.

The symbols may be printed onto the band, but they could also be woven or knit into the band. However, the band may also be colored in a uniform color, in which case it is preferably of a color that is different from that of the remainder of the cover. The band can be knit or woven.

The novel features which are considered as characteristic of the invention are set forth in particular in the appended claims. The invention itself, however, both as to its construction and its method of operation, together with additional objects and advantages thereof will be best understood frown the following description of specific embodiments when read in connection with the accompanying drawing.

BRIEF DESCRIPTION OF THE DRAWING

FIG. 1 is a perspective view from behind of an integral seat/back combination or shell embodying the present invention;

FIGS. 2*a* to 2*f* are views akin to that of FIG. 1 but each showing only a fragment of the seat/back combination at a scale that is enlarged relative to that of FIG. 1;

DETAILED DESCRIPTION OF THE PREFERRED EMBODIMENTS

Figure 2D:
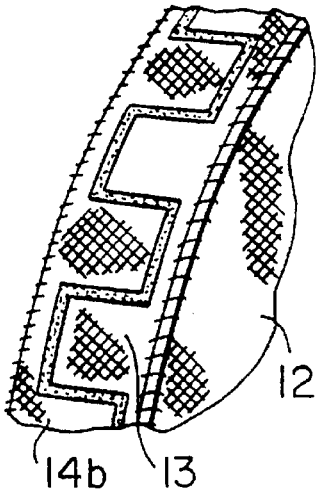
Figure 2E:
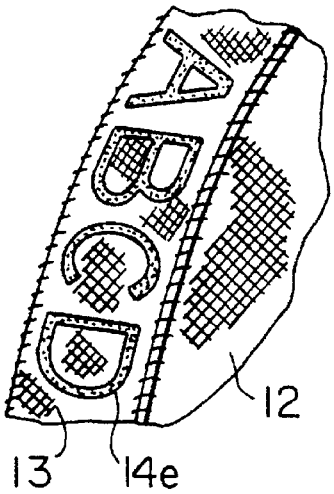
Figure 2F:
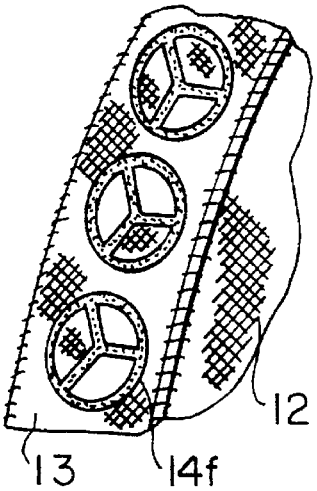

Referring now to the drawing in detail, and first to FIG. 1 thereof, it may be seen that the reference numeral 10 has been used therein to identify a seat/back combination for use as a part of a chair, a bench consisting of a plurality of such combinations arranged next to one another at a spacing from each other, or the like. The combination 10 includes, as is customary, a not illustrated inner support structure that may consist merely of a continuous shell of synthetic plastic material, or of a rigid frame and of springs and/or padding or similar upholstering material mounted thereon. The exact construction of such inner support structure is of little relevance, if any, in the context of the present invention; hence, it has not been illustrated in the drawing in order not to unduly encumber the same. What is important, though, is that the seat/back combination 10 is provided, both on its seat portion and on its backrest portion, with a permanent outside cover.

In the construction illustrated in FIG. 1 of the drawing, the inner structure is indeed continuous, that is the seat portion and the backrest portion are integral with one another, that is they gradually merge into one another. Under these circumstances, the aforementioned outside cover includes, as its main components, a front portion 11 and a rear portion 12. The front portion 11 extends over the front surface of the backrest portion and over the upper surface of the seat portion of the support structure, whereas the rear portion 12 covers the back surface of the backrest portion and the bottom surface of the seat portion of the support structure. The front and rear portions 11 and 12 of the cover are connected to one another, along a circumferentially extending edge region of the seat/backrest combination support structure, by means of a continuous strip or band 13. Advantageously, the band 13 is connected with the two cover portions 11 and 12 by being sewn thereto along respective seams.

It is indicated in FIG. 1 by stippling enclosed in respective circles in FIG. 1 that the band 13 may be provided, in accordance with the present invention, with a series of symbols 14. The symbols 14 are distributed, preferably at equal distances, over the entire length of the continuous band 13, as indicated in the drawing by respective arrows standing instead of additional ones of the symbols 14 that have not been specifically shown.

FIGS. 2*a* to 2*f* show various examples of the symbols 14 (each supplemented with a different letter suffix coinciding with that of the corresponding FIG. to differentiate them from one another) that may be provided on the continuous band to either enhance its aesthetic appeal or to provide advertisement for a sponsor. So, the symbols 14*a* in FIG. 2*a* are constituted by framed squares, the symbols 14*b* in FIG. 2*b* by longitudinally extending stripes differing in color from adjacent ones, and those indicated at 14*c* in FIG. 2*c* by simplified or more elaborate flowers or blooms. Moreover, the band 13 of FIG. 2*d* carries a continuous symbol 14*d* in the form reminiscent of a square wave, that of FIG. 2*e* contains letters 14*e* that may but need not constitute informative, sponsor identification, or advertising text, and the band 13 depicted in FIG. 2*f* carries a series of company logos 14*f*, as illustrated that of the Mercedes-Benz Company. In each case, the symbol or symbols 14*a* to 14*f* is or are visually distinguishable from the background, especially by being of a different color.

Figure 3:
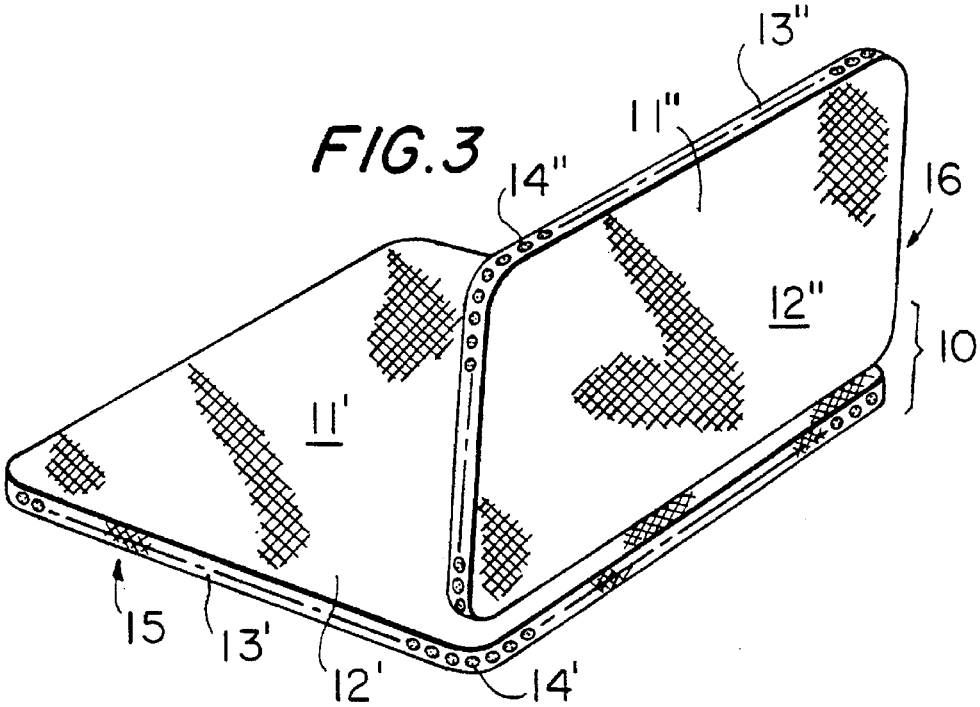
FIG. 3 is a view corresponding to that of FIG. 1 but showing the combination as consisting of separate seat and back components.

While in the construction revealed in FIG. 1 of the drawing the seat proper and the backrest are of one piece with one another, in the modified construction illustrated in FIG. 3 of the drawing they are constituted by separate parts, namely a seat part 15 and a backrest part 16. These parts 15 and 16 are constructed in a manner similar to what was described before and are connected with one another, either directly or via a common supporting structure, in any known manner that is not particularly indicated in the drawing. In accordance with the present invention, the permanent cover of at least one of these separate parts 15 and 16 is provided with the aforementioned band 13. As depicted, each of the parts 15 and 16 is equipped in this manner; in order to distinguish the cover portions corresponding to those of FIG. 1 from one another, those associated with the seat part 15 are supplemented with a single prime and those belonging to the backrest part 16 by a double prime. The respective band 13' or 13" again is provided with a series of symbols 14 akin to those depicted in FIGS. 2*a* to 2*f*.

Figure 4:
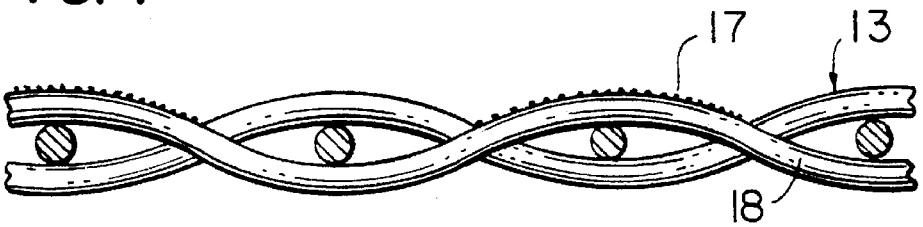
FIG. 4 is a sectional view through any one of FIGS. 2*a* to 2*f* at a still more magnified scale and showing an implementation of the present invention.

FIG. 4 illustrates in some detail how the symbols 14 could be provided on a woven or knit fabric constituting the band 13. More particularly, a color-distinguished area 17 contrasting with the adjacent areas could be provided on some but not all fibers 18 constituting the fabric and/or only along selected portions of the lengths of such fibers 18. The distinguished area 17 could be, for instance, constituted by a layer of dye printed on the underlying fibers 18 only over the desired zones thereof. On the other hand, the selected fibers 18 could be of the same color over their entire lengths and merely emerging to the exposed surface of the band 13 and submerging below it in accordance with the desired pattern to constitute the respective visually distinguished areas cumulatively constituting the symbol 14.

It has been established that, by resorting to the present invention, the affected seating furniture, which may but need not be upholstered, obtains a high degree of noticeability and/or a high advertising value, especially when the band 13 is provided with corresponding logos or company symbols 14.

It will be understood that each of the elements described above, or two or more together, may also find a useful application in other types of constructions differing from the type described above.

While the present invention has been described and illustrated herein as embodied in certain specific constructions of a continuous band interposed between and connecting two separate portions of a permanent seating furniture cover, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An article of seating furniture, comprising:

a) a support structure including a seating portion and a backrest portion, said support structure having oppositely facing major surfaces and a circumferential edge portion extending between said major surfaces, said edge portion including a front edge region extending transversely of said seating portion, a top edge region extending transversely of said backrest portion, and side edge regions at opposite lateral sides of said seating portion and said backrest portion;

b) a cover for the support structure, including two major portions each juxtaposed with one of said major surfaces of said support structure and a continuous visually distinguishable band juxtaposed with said edge portion of said support structure and connected along respective seams with each of said two major portions of said cover, said band extending along a circumferentially complete path along said front, side and top edge regions of said edge portion of said support structure, and having a constant width as considered transversely of said path; and c) visually distinguishable symbols repetitively distributed over the entire length of said circumferentially complete path of said band over said front, side and top edge regions of said edge portion of said support structure.

2. The article of seating furniture as defined in claim 1, wherein said backrest portion is connected with said seating portion; and wherein said cover covers at least one of said seating and backrest portions.

3. The article of seating furniture as defined in claim 2, wherein said seating mad backrest portions of said support structure are integral with and merge into one another; mid wherein said cover continuously covers both said seating portion and said backrest portion of said support structure.

4. The article of seating furniture as defined in claim 1, wherein said symbols are printed onto said band.

5. The article of seating furniture as defined in claim 1, wherein said symbols are woven into said band.

6. The article of seating furniture as defined in claim 1, wherein said symbols are knit into said band.

7. The article of seating furniture as defined in claim 1, wherein said band is of a uniform color visually distinguishable from that of each of said two major portions of said cover.

8. The article of seating furniture as defined in claim 1, wherein said band is woven.

9. The article of seating furniture as defined in claim 1, wherein said band is knit.

* * * * *